United States Patent [19]

Chiaves

[11] 4,000,622

[45] Jan. 4, 1977

[54] SHORING STRUCTURE FOR EMBANKMENTS

[76] Inventor: Carlo Chiaves, Piazza Adriano, 6, Turin, Italy

[22] Filed: May 14, 1975

[21] Appl. No.: 577,369

[30] Foreign Application Priority Data

May 20, 1974 Italy ..... 68577/74

[52] U.S. Cl. ..... 61/39; 52/169.1; 52/293

[51] Int. Cl.[2] ..... E02D 5/20; E04B 1/344

[58] Field of Search ..... 61/39, 49, 35; 52/293, 52/169

[56] References Cited

UNITED STATES PATENTS 3,195,312 7/1965 Rumsey, Jr. ..... 61/39

3,426,541 2/1969 Chiaves ..... 61/39

*Primary Examiner*—Jacob Shapiro

*Attorney, Agent, or Firm*—Sughrue, Rothwell, Mion, Zinn & Macpeak

[57] ABSTRACT

An embankment shoring structure is made up of a number of vertical prefabricated reinforced concrete panels having vertical stiffening ribs on their inside faces and anchored to a concrete foundation cast on site by a bed of cast reinforced concrete, the lower end of each rib terminating in a face inclined to the horizontal through which the reinforcing rods of the panels pass into the bed.

2 Claims, 7 Drawing Figures

SHORING STRUCTURE FOR EMBANKMENTS

The present invention relates to reinforced concrete structures, partly prefabricated and partly cast on site, of the type forming shoring for embankments, such as scarp foundation walls, bridge abutment and side walls, reservoir walls and the like.

The invention relates particularly to embankment shoring structures of the type formed by a number of vertical prefabricated reinforced concrete panels arranged side-by-side so as to form a shoring wall and provided, on the surface facing the material to be supported, with at least one stiffening rib which extends substantially from the base to the top of each panel and which is covered over by the material to be supported. The panels are positioned on site on a cast sub-structure and subsequently anchored by means of the casting of a bed which encloses the lower ends of the panels.

A technical problem which arises in this type of structure is that of providing an anchorage for the panels on the bed which allows the transmission to the latter of the high bending moment which is caused by the supported material acting on the panels. This anchorage constitutes a weak point of the structure inasmuch as in the area of the anchorage there are inevitably discontinuities or faults in the casing, because the prefabricated panel and the bed cast on site are produced at different times. This makes it impossible for the concrete to form a strong monolithic structure.

For this reason, particular importance attaches to the shape and the position of the region in which each panel is anchored to the bed and the arrangement of the steel reinforcing elements which run through this region and connect the stiffening rib to the bed.

The bending moment acting at the anchorage region tends to separate the panel from the bed at this region. It is therefore convenient to increase the dimensions of the anchorage region; moreover, it is necessary to prevent the reinforcing elements which connect the panel to the bed through this region from being stressed unduly in a direction not parallel to their axis. Because of the non-coaxial force acting on the reinforcing elements, in fact, in the area of the stiffening rib and in the area of the bed adjacent the anchorage region there are consequent stresses which tend to crush the concrete which surrounds the reinforcing elements. Consequently, in the anchorage region, a subsequent weakening of the connection between the panel and the bed occurs, which facilitates the rupture of the connection in this region.

The main object of the present invention is to provide a structure of the aforementioned type which solves the technical problem of the anchorage between the panel and the bed by increasing, for given dimensions of prefabricated panel and the bed, the dimensions of the anchorage region and consequently reduce the forces acting on the reinforcing elements. A further object of the invention is to provide a structure in which the forces acting on the reinforcing elements are directed, in the anchoring area of the panel to the bed, substantially along the longitudinal axes of the elements.

With these objects in view the present invention provides a structure for the shoring of embankments of the type comprising a number of substantially vertical prefabricated panels of reinforced concrete arranged side-by-side so as to form a shoring wall, each panel having on its surface which, in use of the panel, faces towards the material to be supported, at least one stiffening rib which extends substantially from the bottom to the top of each panel; the said panels being laid on a foundation cast on site and anchored by a bed of cast reinforced concrete which encloses the lower ends of the panels and which is eventually covered by the supported material, characterised in that the lower end of each stiffening rib of each prefabricated panel is delimited by an inclined face forming, in the shoring structure, an angle between 25° and 60° relatively to the horizontal.

The cross section of the anchorage region thus obtained between the bed and the reinforcing ribs of the panels is, because of the angle of inclination of the interface of the ribs and the base, considerably greater than the corresponding cross section obtainable, for the same size of panel, with a noninclined interface.

Preferably each panel has steel reinforcing elements connecting the bed to the respective stiffening rib of the panel through the base section of the said rib, the elements extending through the said base section in a direction substantially perpendicular to the interface between the said rib and the base section. This results in a reduction of the force acting on the reinforcing elements which connect the ribs to the bed through this interface. This has the advantage that the force acting on the reinforcing elements is directed along the longitudinal axes of the reinforcing elements, which are therefore stressed in working conditions, in the optimum manner.

The invention will now be described, by way of non-limiting example, with reference to the appended drawings, in which.

Figure 1:
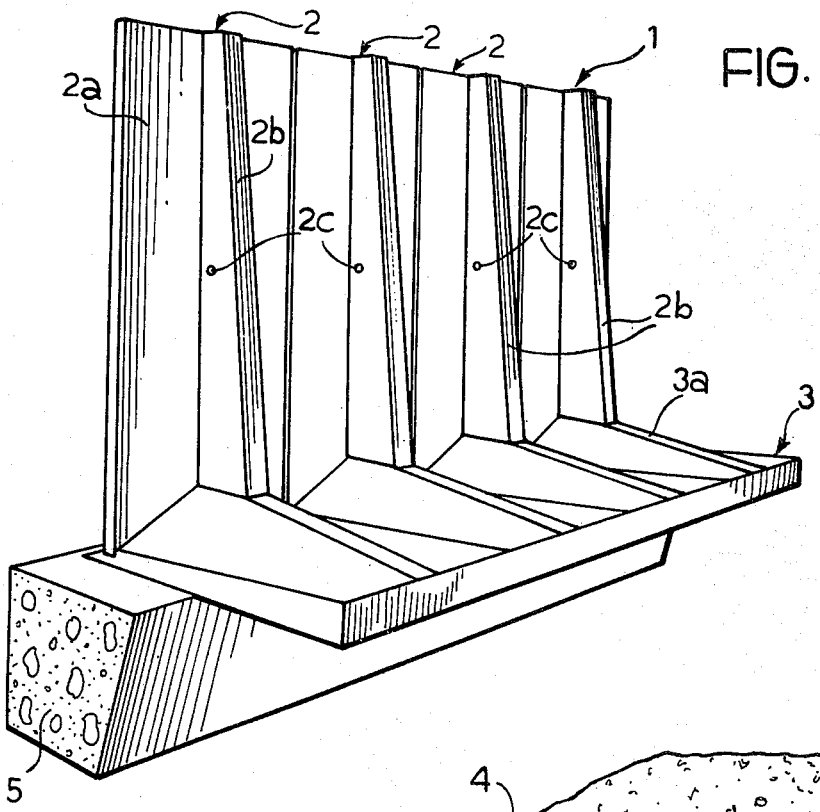
FIG. 1 is a perspective view of part of a structure according to one embodiment of the invention.
Figure 2:
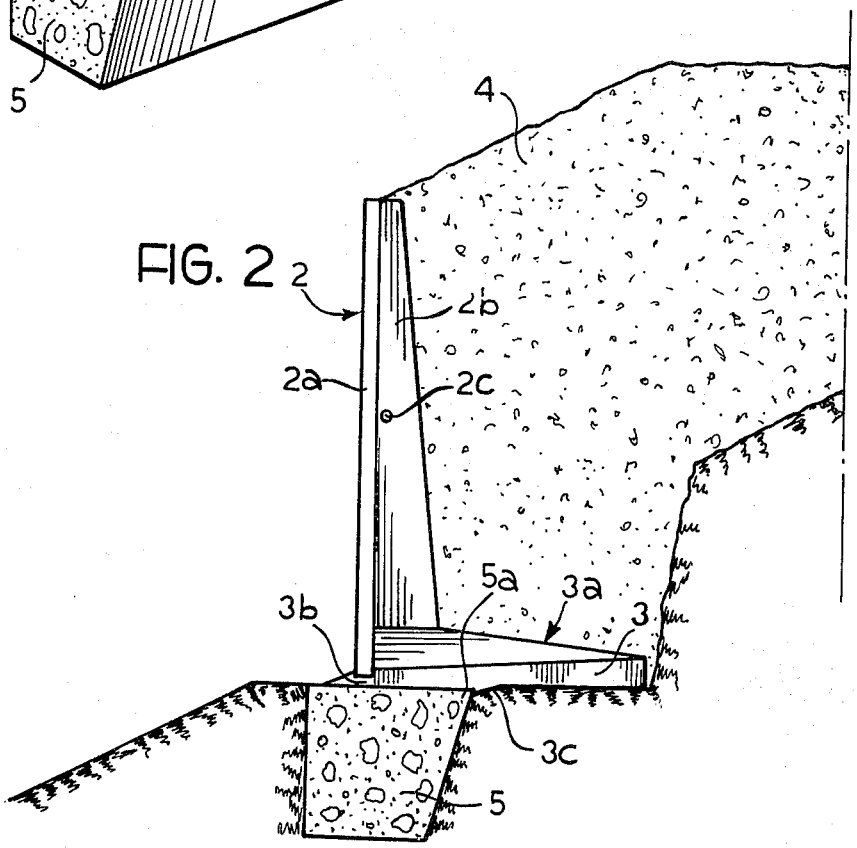
FIG. 2 is a vertical cross section of the structure shown in FIG. 1, in its working condition.

In the drawings, reference numeral 1 indicates an overall view of a structure for the shoring of embankments. The structure 1 is formed by a number of prefabricated panels 2 of reinforced concrete vertically disposed side-by-side so as to form a shoring wall and a supporting bed 3 made of reinforced concrete cast on site. The structure 1 rests on a concrete foundation 5, also cast on site, located directly beneath the vertical wall formed by the panels 2. The material 4 to be supported rests on the bed 3 and against the rear faces of the panels 2, as shown in FIG. 2.

Each prefabricated panel 2 comprises a substantially flat wall **2*a* and a stiffening rib 2*b* which projects from the rear face of the wall 2*a* and extends from the base to the top of the panel 2. The rib 2*b* faces, in use of the panel, towards the material 4 to be supported. The stiffening rib 2*b* is provided in its central area with a through hole 2*c* which allows the panel to be lifted and handled by means of a crane during the transportation and laying in position of the panel. Moreover, the rib 2b has a lower end portion which is delimited by an inclined face 6 (FIG. 2). Steel reinforcing rods 7, 8, 9 and 10 project from the face 6.**

Figure 3:
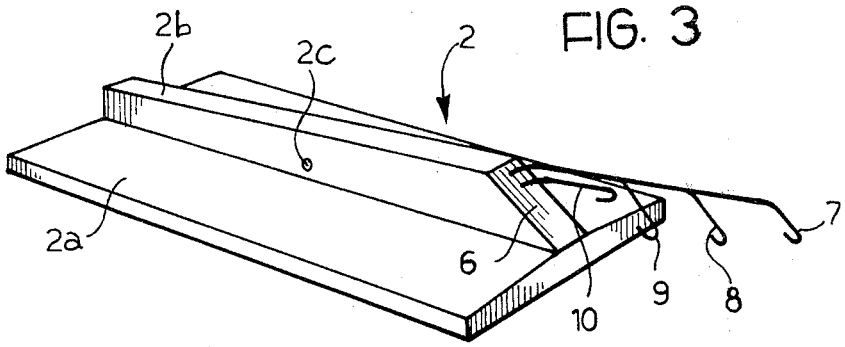
FIG. 3 is a perspective view of a prefabricated element of the structure of FIG. 1, shown in its condition of transportation.
Figure 4:
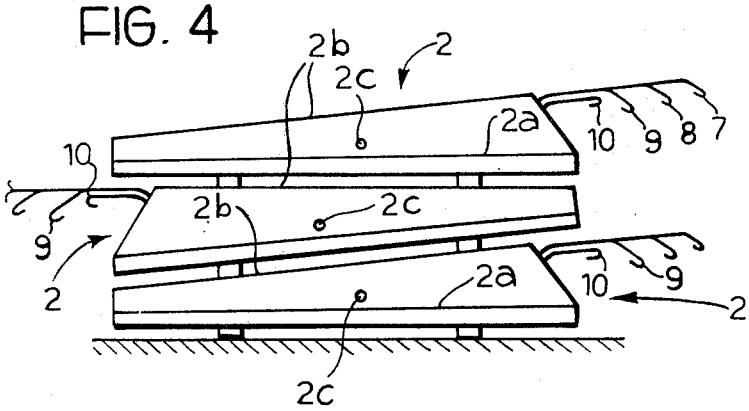
FIG. 4 is a side elevational view of stacked prefabricated elements, like that shown in FIG. 3, arranged in a position for transportation.

During their transportation to the construction and laying site, the panels 2 are stacked one upon another as shown in FIG. 4, the panels 2 being separated from each other by small spacer blocks 11. Upon stacking the panels 2 the rods 7, 8, 9 and 10 are arranged in the manner shown in FIGS. 3 and 4, so that the rods of adjacent superimposed prefabricated panels project in opposite directions.

Figure 5:
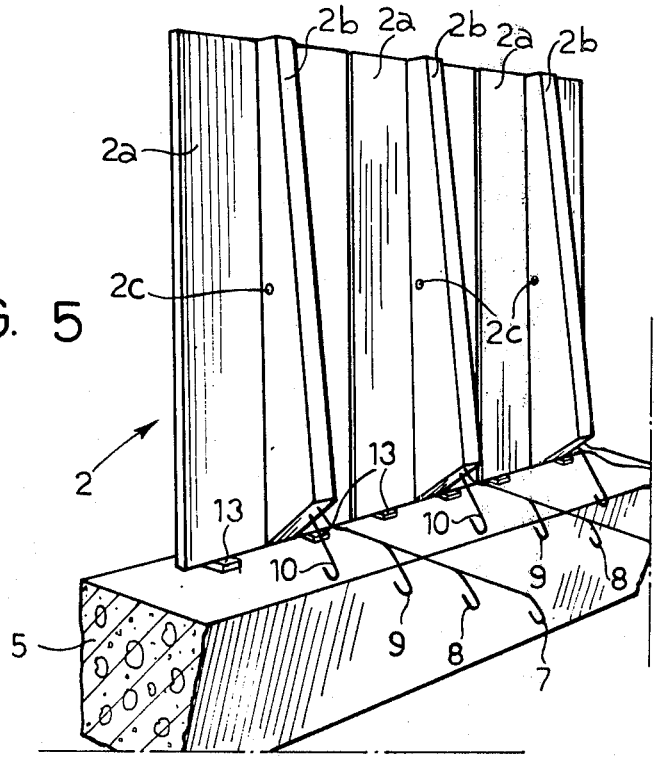
FIG. 5 is a perspective view of the prefabricated element of FIG. 3 in the condition of being laid during construction.

The operations required for laying the panels on site are as follows. Firstly a trench is excavated to receive the foundation 5 which is cast on site. The prefabricated panels 2 are then arranged vertically side-by-side on the foundation 5 with the ribs 2b facing towards the material to be supported. The panels 2 are held in position, slightly spaced from the foundation 5 by means of small spacer blocks 13 (FIG. 5). The reinforcing rods 7, 8 and 9 are subsequently bent over so that they extend approximately perpendicular to the walls 2a of the respective panels 2. Subsequently supplementary reinforcing rods, not shown, which will serve as reinforcement for the bed 3, are placed in position. Finally the bed 3 of reinforced concrete is cast so as to form, in correspondence with the reinforcing rib 2b of each panel 2, a rearwardly projecting part 3a which connects the rib 2b to the bed 3. During this operation the cast concrete which forms the bed 3 fills up the space between each panel 2 and the underlying foundation 5 and forms a small step 3c in correspondence with the adjacent top edge 5a of the foundation 5. The bed 3 embraces the lower part of each panel 2 and secures it simultaneously to the underlying foundation 5.

Figure 6:
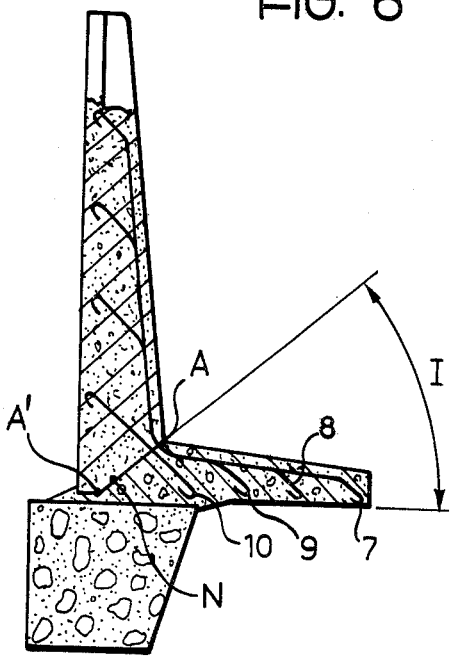
FIGS. 6 and 7 are schematic cross-sectional views of the structure shown in FIG. 1 in two different working conditions.

In this manner a unified structure is formed which comprises the panels 2 and the bed 3, the reinforcing rods 7, 8, 9, and 10, which connect the rib 2b of each panel 2 with the bed 3, being arranged as shown in FIG. 6. The line A–A′ represents the inclined face 6 of the rib 2b and I indicates the angle of inclination of the face 6 to the horizontal base plane of the bed 3.

Figure 7:
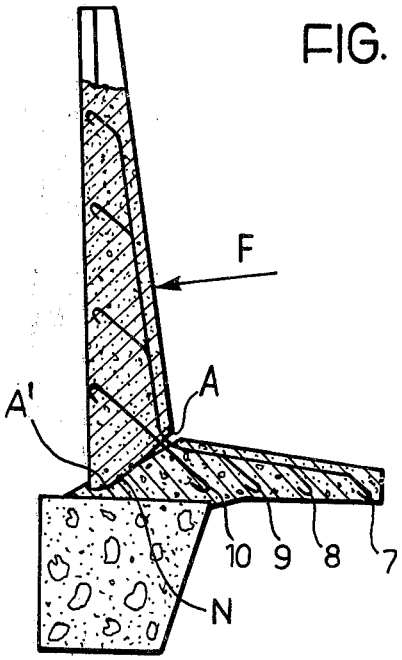

The panel according to the invention therefore has an anchorage region or base section which is of considerably greater cross-sectional area than that obtainable with the same panel supported on a horizontal surface. The force F applied to the panel by the supported material exerts a turning moment on the panel 2 tending to rotate the panel 2 relatively to the bed 3 about an axis in the section A A′. Consequently when this loading force becomes sufficiently high a slight cracking of the concrete occurs in the plane A–A′, the crack starting from the point A and reaching the point N, which in FIGS. 6 and 7 represents the neutral axis of the section A A′.

The reinforcing rods 7, 8, 9, and 10 are therefore subjected to tensile stress. Because these rods extend across the base section plane A A′ of the rib 2 in a direction substantially perpendicular to the said section plane, the tensile stress acting on the rods is directed along the longitudinal axes of the rods, which is a practical advantage. The angle I formed between the inclined face 6 of the rib 2b and the horizontal plane depends on the depth of the rib 2b and the thickness of the bed 3 at its zone of connection 3a to the said rib 2b. The angle I cannot, therefore, fall to very low values, for example less then 25°, nor can the angle I assume very high values, exceeding for example 60°. In practice the magnitude of the angle I lies within the range of 30° to 45°, the actual value within this range increasing with increasing height of the panel.

In the preceding description and drawings there have been shown, for reasons of clarity, only those reinforcing rods of the rib 2b of the panel and the bed 3 which form part of the connection according to the invention between the rib and the bed.

It will be appreciated that while adhering to the principle of the invention, practical embodiments and constructional details may be widely varied, relatively to what has been described and illustrated, without departing from the scope of the present invention.

I claim:

1. A shoring structure for embankments, of the type comprising a number of substantially vertical prefabricated panels of reinforced concrete arranged side-by-side so as to form a shoring wall, each panel having on its surface which faces the material to be supported, at least one stiffening rib extending substantially from the bottom to the top of each panel, a foundation for said panels, said foundation being cast on site, and a bed of cast reinforced concrete which encloses the lower ends of the panels and anchors the latter to said foundation, said bed being eventually covered by the supported material, wherein the improvement consists in the lower end of each stiffening rib of each prefabricated panel being delimited by an inclined face extending for the whole width of the rib, starting from the bottom of the panel, which inclined face when in place faces the material to be supported; said inclined face forming, in the shoring structure, an angle to the horizontal between 25° and 60°, and reinforcing elements connecting the bed to the respective stiffening rib passing through said inclined face in a direction perpendicular thereto.

2. The structure defined in claim 1, wherein the said angle to the horizontal is between 30° and 45°.

* * * * *